US007220352B2

(12) United States Patent
Halbert et al.

(10) Patent No.: US 7,220,352 B2
(45) Date of Patent: May 22, 2007

(54) SELECTIVE HYDRODESULFURIZATION OF NAPHTHA STREAMS

(75) Inventors: Thomas R. Halbert, Baton Rouge, LA (US); John P. Greeley, Annandale, NJ (US); Brij N. Gupta, Thornhill (CA); Garland B. Brignac, Clinton, LA (US); Chu Siang Loo, Toronto (CA)

(73) Assignee: Exxonmobil Research and Engineering Company, Annandale, NJ (US)

( * ) Notice: Subject to any disclaimer, the term of this patent is extended or adjusted under 35 U.S.C. 154(b) by 81 days.

(21) Appl. No.: 10/372,864

(22) Filed: Feb. 24, 2003

(65) Prior Publication Data

US 2003/0183556 A1 Oct. 2, 2003

Related U.S. Application Data

(60) Provisional application No. 60/369,449, filed on Apr. 2, 2002.

(51) Int. Cl.
*G10G 45/02* (2006.01)

(52) U.S. Cl. ..... 208/216 R; 208/213; 208/217

(58) Field of Classification Search ..... 208/213, 208/216 R, 217
See application file for complete search history.

(56) References Cited

U.S. PATENT DOCUMENTS

| | | | | |
|---|---|---|---|---|
| 3,003,953 | A | 10/1961 | Evans | 208/254 |
| 3,475,327 | A | 10/1969 | Eng et al. | 208/211 |
| 4,132,632 | A | 1/1979 | Yu et al. | 208/216 |
| 5,985,136 | A | 11/1999 | Brignac et al. | 208/216 R |
| 6,013,598 | A | 1/2000 | Lapinski et al. | 502/305 |
| 6,126,814 | A | 10/2000 | Lapinski et al. | 208/217 |

FOREIGN PATENT DOCUMENTS

| | | |
|---|---|---|
| GB | 719231 | 1/1954 |
| GB | 1197771 | 8/1970 |

OTHER PUBLICATIONS

S. J. Tauster et al., "Structure and Properties of Molybdenum Sulfide: Correlation of O2 Chemisorption with Hydrodesulfurization Activity," *Journal of Catalysis 63*, pp. 515-519 (1980).

*Primary Examiner*—Glenn Caldarola
*Assistant Examiner*—John Douglas
(74) *Attorney, Agent, or Firm*—Gerard J. Hughes; Lawrence E. Carter

(57) ABSTRACT

A process for the selective hydrodesulfurization of naphtha streams containing sulfur and olefins. A substantially olefins-free naphtha stream is blended with an olefins/sulfur-containing naphtha stream and hydrodesulfurized resulting in the substantial removal of sulfur without excessive olefin saturation.

2 Claims, No Drawings

SELECTIVE HYDRODESULFURIZATION OF NAPHTHA STREAMS

CROSS REFERENCE TO RELATED APPLICATION

This patent application claims benefit of U.S. Provisional Patent Application Ser. No. 60/369,449 filed Apr. 2, 2002.

FIELD OF THE INVENTION

The present invention relates to a process for the selective hydrodesulfurization of naphtha streams containing sulfur and olefins. A substantially olefins-free naphtha stream is blended with an olefinic cracked naphtha stream and hydrodesulfurized resulting in the substantial removal of sulfur without excessive olefin saturation.

BACKGROUND OF THE INVENTION

Environmentally driven regulatory pressures concerning motor gasoline ("mogas") are expected to increase demand for mogas having no more than about 50 wppm sulfur, and preferably less than about 10 wppm. In general, this will require deep desulfurization of olefinic cracked naphthas, such as cat naphthas. That is, naphthas resulting from cracking operations that typically contain substantial amounts of both sulfur and olefins. Deep desulfurization of cat naphtha requires improved technology to reduce sulfur levels without the severe loss of octane that accompanies the undesirable saturation of olefins.

Hydrodesulfurization is a hydrotreating process for the removal of feed sulfur by conversion to hydrogen sulfide. Conversion is typically achieved by reaction of the feed with hydrogen over non-noble metal sulfided supported and unsupported catalysts, especially those of Co/Mo and Ni/Mo. Severe temperatures and pressures may be required to meet product quality specifications or to supply a desulfurized stream to a subsequent sulfur sensitive process.

Olefinic cracked naphthas and coker naphthas typically contain more than about 20 wt. % olefins. At least a portion of the olefins are hydrogenated during conventional hydrodesulfurization. Since olefins are relatively high octane number species components, it may be desirable to retain the olefins rather than to hydrogenate them to saturated compounds. Conventional fresh hydrodesulfurization catalysts have both hydrogenation and desulfurization activity. Hydrodesulfurization of cracked naphthas using conventional naphtha desulfurization catalysts following conventional startup procedures and under conventional conditions required for sulfur removal, produces a significant loss of olefins through hydrogenation. This results in a lower grade fuel product that needs additional refining, such as isomerization, blending, etc., to produce higher octane fuels. This, of course, adds significantly to production costs.

Selective hydrodesulfurization involves removing sulfur while minimizing hydrogenation of olefins and octane reduction by various techniques, such as selective catalysts, process conditions, or both. For example, ExxonMobil's SCANfining process selectively desulfurizes catalytically cracked naphthas with little loss in octane. U.S. Pat. Nos. 5,985,136; 6,013,598; and 6,126,814, all of which are incorporated by reference herein, disclose various aspects of SCANfinig. Although selective hydrodesulfurization processes have been developed to avoid olefin saturation and loss of octane number, such processes can liberate $H_2S$ that reacts with retained olefins to form mercaptan sulfur by reversion.

Stricter mogas sulfur regulations will also make it necessary to desulfurize certain virgin naphtha streams that have in the past been directly blended into the mogas pool without being hydrodesulfurized because of their relatively low sulfur content. Mild hydrotreating technology to reduce virgin naphtha sulfur to very low levels with no significant loss of octane number is known, but the construction and operation of an additional hydrotreater dedicated to this service would be undesirably costly.

Consequently, there is a need for technology that will reduce the cost of hydrotreating both olefinic cracked naphthas and naphthas that are substantially free of olefins.

SUMMARY OF THE INVENTION

The invention relates to a process for desulfurizing naphtha feedstreams that contain both sulfur and olefins, comprising:

a) blending an effective amount of a naphtha stream that is substantially free of olefins with an olefinic cracked naphtha stream, wherein both naphtha streams contain sulfur; and b) selectively hydrodesulfurizing the blend of naphtha streams in the presence of a hydrodesulfurizing catalyst, at reaction conditions including temperatures from about 230° C. to about 425° C., pressures of about 60 to 800 psig, and hydrogen treat gas rates of about 1000 to 6000 standard cubic feet per barrel; and wherein mercaptan reversion is minimized.

In one embodiment, the amount of substantially olefins-free naphtha in the naphtha blend is from about 10 wt. % to about 80 wt. %, based on the total weight of the blended naphtha stream.

In another embodiment, the hydrodesulfurization catalyst is comprised of a Mo catalytic component, a Co catalytic component and a support component, with the Mo component being present in an amount of from 1 to 10 wt. % calculated as $MoO_3$ and the Co component being present in an amount of from 0.1 to 5 wt. % calculated as CoO, with a Co/Mo atomic ratio of 0.1 to 1.

DETAILED DESCRIPTION OF THE INVENTION

Suitable feedstocks include hydrocarbon streams such as refinery streams boiling, at atmospheric pressure, in the naphtha boiling range, which is typically from about 10° C. (50° F.) to about 232.2° C. (450° F.), preferably from about 21° C. (70° F.) to about 221° C. (430° F.). In one embodiment, the naphtha feedstream to be desulfurized will contain an olefinic cracked naphtha stream and a substantially olefins-free naphtha stream. The olefinic cracked naphtha stream will typically have an olefins content of at least about 5 wt. %. Non-limiting examples of such olefinic cracked naphtha feedstreams, which will also contain a significant amount of sulfur, include fluid catalytic cracking unit naphtha (cat naphtha), and coker naphtha. Cat naphtha and coker naphtha are generally olefin-containing naphthas since they are products of catalytic and/or thermal cracking reactions, and thus are the more preferred streams to be treated in accordance with the present invention. By substantially olefins-free naphtha stream is meant a refinery feedstream boiling in the naphtha range and containing less than about 5 wt. %, preferably less than about 3 wt. % olefins content, based on the total weight of the stream. A preferred substantially olefins-free stream is a virgin naphtha stream. Such a stream is also sometimes referred to as a straight-run naphtha. The sulfur content of the substantially olefins-free naphtha stream will typically be less than about 1000 wppm sulfur, preferably less than about 500 wppm sulfur, and more preferably less than about 100 wppm sulfur.

The olefinic cracked naphtha feedstream will generally contain not only paraffins, naphthenes, and aromatics, but also unsaturates, such as open-chain and cyclic olefins, dienes, and cyclic hydrocarbons with olefinic side chains. The olefinic cracked naphtha feedstream typically also contains an overall olefins concentration ranging as high as about 60 wt. %, more typically as high as about 50 wt. %, and most typically from about 5 wt. % to about 40 wt. %. The olefinic cracked naphtha feedstream can also have a diene concentration up to about 15 wt. %, but more typically less than about 5 wt. % of the feedstream. High diene concentrations are undesirable since they can result in a gasoline product having poor stability and color. The sulfur content of the olefinic cracked naphtha will generally range from about 300 wppm to about 7000 wppm, more typically from about 500 wppm to about 5000 wppm. The nitrogen content will typically range from about 5 wppm to about 500 wppm.

It would be desirable to remove the sulfur from such olefinic cracked naphthas with as little olefin saturation as possible. Also, it would be desirable to convert as much of the organic sulfur species of the olefinic cracked naphtha to $H_2S$ with as little mercaptan reversion as possible. The level of mercaptans in the product stream has been found to be directly proportional to the concentration of both $H_2S$ and olefinic species at the reactor outlet, and inversely related to the temperature at the reactor outlet. Surprisingly, it has been found that co-processing a blend of substantially olefins-free naphtha with an olefinic cracked naphtha in a selective hydrodesulfurization will result in a product stream having low levels of sulfur and a relatively low level of mercaptan reversion. It has also been unexpectedly found that the blending of these two types of naphtha feedstreams prior to hydrodesulfurization results in less octane number loss than would occur if the two streams were separately hydrodesulfurized to achieve the same target sulfur level. The amount of substantially olefins-free naphtha to olefinic cracked naphtha should be at least an effective amount. By effective amount we mean at least that amount that will result in at least a 1/10th octane number improvement when compared to the case where the two types of naphtha streams are processed separately. It is preferred that there be at least a 1/5th octane number improvement and more preferably at least a 3/10ths octane number improvement. The octane number referred to herein is preferably Road Octane Number with is equal to the Research Octane Number plus the Motor Octane Number divided by 2. The amount of substantially olefins-free naphtha will typically be less than about 80 wt. %, preferably less than about 50 wt. %, and more preferably less than about 25 wt. %, based on the total weight of the blended naphtha stream. The precise amount of substantially olefins-free naphtha to olefinic cracked naphtha will vary depending on such things as the availability of a reformer capacity to process the substantially olefins-free naphtha. This amount will also vary with the amount of $C_4$, $C_5$, and $C_6$ components present in the stream, as well as the amount of substantially olefins-free naphtha that will be available in any particular refinery.

It is desired that the product blended naphtha stream, after hydrodesulfurization have a sulfur content less than about 30 wppm and an octane number loss of less than the octane loss that would occur if the two naphtha streams were processed separately.

In one embodiment, the invention relates to a catalytic hydrodesulfurization process employing a feed comprising an olefinic cracked naphtha and a naphtha substantially free of olefins. The combined feedstream (olefinic cracked naphtha+substantially olefins-free naphtha) is initially preheated prior to entering the hydrodesulfurization reactor for final preheating to a targeted reaction zone inlet temperature. The feedstream can be contacted with a hydrogen-containing stream prior to, during, and/or after preheating. The hydrogen-containing stream can also be added at an intermediate location in the hydrodesulfurization reaction zone. The hydrogen-containing stream can be substantially pure hydrogen or can be in a mixture with other components found in refinery hydrogen streams. It is preferred that the hydrogen-containing stream contain little, if any, hydrogen sulfide. The hydrogen-containing stream purity should be at least about 50% by volume hydrogen, preferably at least about 75% by volume hydrogen, and more preferably at least about 90% by volume hydrogen for best results.

In one embodiment, selective hydrodesulfurization conditions are employed. Selective hydrodesulfurization will be a function of the concentration and types of sulfur of the feedstream. Generally, hydrodesulfurization conditions include: temperatures from about 230° C. to about 425° C., preferably from about 260° C. to about 355° C.; pressures from about 60 to 800 psig, preferably from about 200 to 500 psig; hydrogen feed rates of about 1000 to 6000 standard cubic feet per barrel (scf/b), preferably from about 1000 to 3000 scf/b; hydrogen purity from about 20 to 100 vol. %, preferably from about 65 to 100 vol. %; and liquid hourly space velocities of about 0.5 $hr^{-1}$ to about 15 $hr^{-1}$, preferably from about 0.5 $hr^{-1}$ to about 10 $hr^{-1}$, more preferably from about 1 $hr^{-1}$ to about 5 $hr^{-1}$.

Hydrodesulfurization may occur in one or more reaction zones using, for example, fixed catalyst bed(s). Each reaction zone can be comprised of one or more fixed bed reactors comprising one or more catalyst beds. It will be understood that other types of catalyst beds can be used, such as fluid beds, ebullating beds, moving beds, etc. Interstage cooling between fixed bed reactors, or between catalyst beds in the same reactor, can be employed since some olefin saturation will take place, and olefin saturation and the desulfurization reaction are generally exothermic. A portion of the heat generated during hydrodesulfurization can be recovered. Where this heat recovery option is not available, cooling may be performed through cooling utilities such as cooling water or air, or through use of a hydrogen quench stream. In this manner, optimum reaction temperatures can be more easily maintained.

Conventional hydrotreating catalysts are suitable for use in the hydrodesulfurization process. For example, suitable catalysts include those comprised of at least one Group VIII metal, preferably Fe, Co and Ni, more preferably Co and/or Ni, and most preferably Co; and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same bed. The Group VIII metal is typically present, as the metal oxide, in an amount ranging from about 0.1 wt. % to about 10 wt. %, preferably from about 0.1 wt. % to 5 wt. %. The Group VI metal will typically be present, in the metal oxide form, in an amount ranging from about 1 wt. % to about 40 wt. %.

When selective hydrodesulfurization conditions are employed, one preferred catalyst comprises: (a) a $MoO_3$ concentration of about 1 to 10 wt. %, preferably about 2 to 8 wt. %, and more preferably about 4 to 6 wt. %, based on the total weight of the catalyst; (b) a CoO concentration of about 0.1 to 5 wt. %, preferably about 0.5 to 4 wt. %, and more preferably about 1 to 3 wt. %, also based on the total weight of the catalyst; (c) a Co/Mo atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a $MoO_3$ surface concentration of about $0.5\times10^{-4}$ to about $3\times10^{-4}$ g. $MoO_3/m^2$, preferably about $0.75\times10^{-4}$ to about $2.5\times10^{-4}$, more preferably from about $1\times10^{-4}$ to about $2\times10^{-4}$; and (f) an average particle size diameter of less than 2.0 mm, preferably less than about 1.6 mm, more preferably less than about 1.4 mm, and most preferably as small as practical for a commercial hydrodesulfurization process unit. The most preferred catalysts will also have a high degree of metal sulfide edge plane area as measured by the Oxygen Chemisorption Test described in "Structure and Properties of Molybdenum Sulfide: Correlation of $O_2$ Chemisorption with Hydrodesulfurization Activity," S. J. Tauster et al., *Journal of Catalysis* 63, pp 515-519 (1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to 2,800, preferably from about 1,000 to 2,200, and more preferably from about 1,200 to 2,000 μmol oxygen/gram $MoO_3$. The terms hydrotreating and hydrodesulfurization are sometimes used interchangably by those skilled in the art.

Supported catalysts may be employed for hydrodesulfurization. One or more inorganic oxides may be used as a support material. Suitable support materials include: alumina, silica, titania, calcium oxide, strontium oxide, barium oxide, carbons, zirconia, diatomaceous earth, lanthanide oxides including cerium oxide, lanthanum oxide, neodynium oxide, yttrium oxide, praesodynium oxide, chromia, thorium oxide, urania, niobia, tantala, tin oxide, zince oxide, and aluminum phosphate. Alumina, silica, and silica-alumina are preferred. More preferred is alumina. For the catalysts with a high degree of metal sulfide edge plane area of the present invention, magnesia can also be used. It is to be understood that the support material can contain small amounts of contaminants, such as Fe, sulfates, silica, and various metal oxides that can be present during the preparation of the support material. These contaminants are present in the raw materials used to prepare the support and will preferably be present in amounts less than about 1 wt. %, based on the total weight of the support. It is more preferred that the support material be substantially free of such contaminants. About 0 to 5 wt. %, preferably from about 0.5 to 4 wt. %, and more preferably from about 1 to 3 wt. %, of an additive can also be present in the support, which additive is selected from the group consisting of phosphorus and metals or metal oxides from Group IA (alkali metals) of the Periodic Table of the Elements.

The following examples are presented to illustrate the invention.

EXAMPLE 1

In this example, the octane loss expected for separate hydrotreating of an olefinic cracked naphtha and a substantially olefins-free naphtha (SOF naphtha) is established for the two feeds with feedstock properties given in Table I below. The olefinic cracked naphtha was a cat naphtha and the SOF naphtha was a virgin naphtha. The high sulfur cat naphtha is selectively hydrotreated over a catalyst comprised of about 4.3 wt. % $MoO_3$, 1.2 wt. % CoO on an alumina support having a surface area of about 280 $m^2/g$ and a medium pore diameter of about 95 Å to produce a product with 86 wppm sulfur. Conditions required to reach this target are given in Table II below. The conditions and resulting product qualities are predicted based on a kinetic model developed from a pilot plant database.

TABLE I

| | Olefinic Cracked Naphtha | SOF Naphtha |
|---|---|---|
| API Gravity (degrees) | 48.8 | 61.3 |
| Specific Gravity (g/cc) | 0.7848 | 0.7339 |
| Sulfur (wppm) | 3340 | 200 |
| Bromine Number (cg/g) | 50.7 | 1.0 |
| Boiling Point (° F.) | | |
| 10% | 171 | 149 |
| 50% | 258 | 217 |
| 90% | 344 | 338 |

TABLE II

| | |
|---|---|
| Average Reactor Temperature (° F.) | 525 |
| Treat Gas Rate (scf/bbl) | 2000 |
| Pressure (psig) | 227 |
| Liquid Hourly Space Velocity | 1.5 |
| Treat Gas Hydrogen Purity (%) | 100 |

Predicted product properties are given in the first column of Table III below for the hydrotreated olefinic cracked naphtha product. The expected loss in Road Octane (R+M/2) is 3.8 octane numbers.

The relatively low sulfur SOF naphtha is treated in a separate hydrodesulfurization unit, under conventional non-selective hydrodesulfurization conditions, to reach sulfur levels of about 2 wppm. The second column of Table III below gives expected product qualities for the hydrotreated SOF naphtha. No significant octane loss is expected during desulfurization of this stream.

Expected product qualities are also shown in column three of Table III for a blend of the two hydrodesulfurized streams at a volumetric ratio of 12:15 (olefinic cracked naphtha:SOF naphtha). This blend has an overall sulfur content of 41 wppm, and shows a net loss in Road Octane of 1.7 octane number.

TABLE III

| | Hydrotreated Olefinic Cracked Naphtha | Hydrotreated SOF Naphtha | Hydrotreated Olefinic plus SOF Naphthas |
|---|---|---|---|
| Volumetric Rate (kbd) | 12 | 15 | 27 |
| S (wppm) | 86 | 2 | 41 |
| Bromine Number (cg/g) | 27 | 0 | 12.4 |
| RON Loss | 5.5 | 0 | 2.4 |
| MON Loss | 2.1 | 0 | 0.9 |
| Road Octane Loss | 3.8 | 0 | 1.7 |

EXAMPLE 2

In this example, the octane loss expected for combining the olefinic cracked naphtha and SOF naphtha streams of Example 1 hereof is established and shown to be less than that for the separate processing approach of Example 1. Table IV below gives selected properties of the feed formed by blending the untreated olefinic cracked and SOF naphthas at a ratio of 12:15 parts by volume. Conditions required to reduce the sulfur level of this combined feed to 41 wppm S are also given this Table IV.

TABLE IV

| | 12:15 Blend of Cat and Virgin Naphtha |
|---|---|
| API Gravity (degrees) | 55.5 |
| Specific Gravity (g/cc) | 0.7565 |
| Sulfur (wppm) | 1648 |
| Br Number (cg/g) | 23.9 |
| Average Reactor Temperature (° F.) | 525 |
| Treat Gas Rate (scf/b) | 2000 |
| Pressure (psig) | 227 |
| Liquid Hourly Space Velocity | 1.37 |
| Treat Gas Hydrogen Purity (%) | 100 |

Product properties for the co-processed stream are given in Table V below. At the target sulfur level of 41 wppm, the bromine number of the product is expected to be 14, which is 1.6 cg/g higher than the bromine number of the combined products of separate hydroprocessing in Example 1 hereof. This higher bromine number, which reflects a higher octane content, results in a significantly lower loss of octane in the combined streams (1.4 Road Octane) and represents an unexpected benefit for co-processing the SOF and olefinic cracked naphthas.

TABLE V

| | Co-processed Olefmic Cracked and SOF Naphtha |
|---|---|
| Sulfur (wppm) | 41 |
| Bromine Number (cg/g) | 14 |
| RON Loss | 2 |
| MON Loss | 0.7 |
| Road Octane Loss | 1.4 |

What is claimed is:

1. A process for hydrodesulfurizing naphtha feedstreams containing both sulfur and olefins using selective hydrodesulfurization, which process comprises:

a) blending an effective amount of a substantially olefins-free naphtha feedstream with an olefinic cracked naphtba feedstream, said olefinic cracked naphtha feedstrearn containing sulfur and having at least 5 wt % olefins content, based on the total weight of the feedstream, each stream in said blend of naphthas boiling at about 232° C. or less; and b) selectively hydrodesulfurizing said blend of naphthas in the presence of a hydrdesulfurizing catalyst, at reaction conditions including temperatures from about 230° C. to about 425° C., pressures of about 60 to 800 psig, and hydrogen treat rate of about 1000 to 6000 standard cubic feet per barrel; wherein mercaptan reversion is minimized to produce a hydrodesulfurized product stream;

c) wherein the olefinic cracked naphtha feedstream contains up to about 7000 wppm sulfur and up to about 60 wt. % olefins, and wherein the final hydrodesulfurization reduces the feed sulfur by at least 90% with no more than 60% olefin saturation, the amount of sulfur in the feed after final hydrodesulfurization is about 30 wppm or less.

2. The process of claim 1, wherein the amount of substantially olefms-free naphtha feedstream in the naphtha blend is from about 10 wt % to about 80 wt. %.

* * * * *